United States Patent [19]

Ikezaki et al.

[11] Patent Number: 4,712,334

[45] Date of Patent: Dec. 15, 1987

[54] ANTI-CLOGGING DEVICE FOR GRINDING WHEEL

[75] Inventors: Yasuo Ikezaki, Kanagawa; Tadashi Matsuoka, Tokyo; Kazuyuki Mitani, Tokyo, all of Japan

[73] Assignees: Toshiba Tungaloy Co., Ltd.; Science & Creative Co., Ltd.; Toyomitsu Kogyo, Co., Ltd., all of Japan

[21] Appl. No.: 901,198

[22] Filed: Aug. 28, 1986

[30] Foreign Application Priority Data

Sep. 5, 1985 [JP] Japan ..... 60-196773

[51] Int. Cl.[4] ..... B24B 55/02

[52] U.S. Cl. ..... 51/262 A; 51/267; 125/11 R

[58] Field of Search ..... 51/262 A, 262 T, 267, 51/5 D; 125/11 R; 219/50, 69

[56] References Cited

U.S. PATENT DOCUMENTS

| | | | |
|---|---|---|---|
| 3,123,951 | 3/1964 | Kuris et al. | 51/262 A |
| 3,747,284 | 7/1973 | Lyczko | 51/267 |

FOREIGN PATENT DOCUMENTS

| | | |
|---|---|---|
| 924075 | 4/1963 | United Kingdom . |
| 1080309 | 4/1967 | United Kingdom . |
| 1576928 | 10/1980 | United Kingdom . |

*Primary Examiner*—Frederick R. Schmidt
*Assistant Examiner*—Maurina T. Rachuba
*Attorney, Agent, or Firm*—Saidman, Sterne, Kessler & Goldstein

[57] ABSTRACT

In an anti-clogging device, an opposed member is provided to be opposed to the grinding surface of a grinding wheel over a predetermined length with a fine space therebetween. During grinding, cutting eliminating liquid is fed into the fine space between the opposed member and the grinding surface from the end facing in the direction opposite to the rotating direction of the grinding wheel to prevent the grinding surface from being clogged with cuttings.

10 Claims, 5 Drawing Figures

ANTI-CLOGGING DEVICE FOR GRINDING WHEEL

BACKGROUND OF THE INVENTION

1. Field of the Invention

This invention relates to an anti-clogging device for a grinding wheel for removing cuttings from the surface of the grinding wheel during grinding.

2. Description of the Prior Art

As is well known, a grinding wheel has a grinding surface comprising abrasive grains bonded to a base material by a binder. When cuttings of a material to be ground are deposited between the grains to clog the spaces between the grains during grinding, the grinding ability of the grinding wheel is lowered and the grinding wheel chatters which can lead to breakage of the grinding wheel. Accordingly, dressing must be effected when the grinding surface is clogged with cuttings. However, in view of the working efficiency, it is preferred that dressing be effected less frequently.

SUMMARY OF THE INVENTION

In view of the foregoing observations and description, the primary object of the present invention is to provide an anti-clogging device for removing cuttings from the grinding surface of the grinding wheel during grinding, thereby preventing clogging of the grinding surface with cuttings.

The anti-clogging device in accordance with the present invention comprises an opposed member which is opposed to the grinding surface of the grinding wheel over a predetermined length with a fine space therebetween, and an eliminating liquid feeding means which feeds cutting eliminating liquid into the fine space between the opposed member and the grinding surface from the end facing in the direction opposite to the rotating direction of the grinding wheel.

The eliminating liquid is forced into the fine space by rotation of the grinding wheel and is compressed, whereby the centripetal component of the pressure of the eliminating liquid with respect to the rotational axis of the grinding wheel is increased. The increased centripetal component of the eliminating liquid pressure abruptly changes at the exit end of the space. The change of the centripetal component of the eliminating liquid at the exit end of the space virtually acts as a negative pressure and removes cuttings from the grinding surface.

DESCRIPTION OF THE PREFERRED EMBODIMENT

Figure 1:
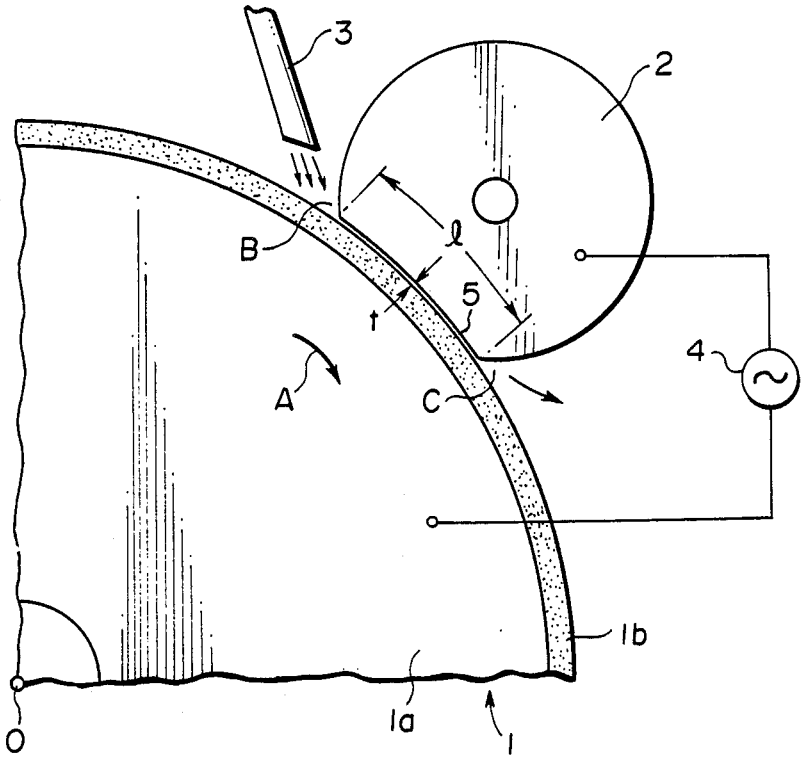
FIG. 1 a fragmentary end view showing a grinding wheel together with an anti-clogging device in accordance with an embodiment of the present invention.

In FIG. 1, a grinding wheel 1 is mounted on a machine tool (not shown) such as a grinder, a machining center or the like for rotation about a central axis O in the direction of arrow A at a predetermined speed. In the machine tool, there is provided a means for supplying grinding liquid to the area where the opposed member is ground. The grinding wheel 1 comprises a cylindrical base body 1*a* and an abrasive grain layer 1*b* formed on the outer peripheral surface of the base body 1*a*. The abrasive grain layer 1*b* comprises abrasive grains such as of diamond, CBN or the like dispersed in a binder, and has a substantially uniform thickness. In this particular embodiment, the grinding wheel 1 is cylindrical or disk like in shape, and has the grinding surface on the outer peripheral surface thereof. That is, the grinding wheel 1 is rotated at a high speed and is brought into contact with a material-to-be-ground at the outer peripheral surface thereof.

An opposed member 2 is disposed to be opposed to the outer peripheral surface or the grinding surface of the grinding wheel 1 over a predetermined length l with a fine space 5 (having a width of t) therebetween. Typically, the opposed member is formed by grinding a cylindrical member with the grinding wheel 1. In this case, it is preferred that the opposed member 2 be of a material which is relatively soft and less affects the grinding wheel 1. An eliminating water feeding nozzle 3 is provided to feed cutting eliminating water into the fine space 5 from the end B facing in the direction opposite to the rotating direction A of the grinding wheel 1. The cutting eliminating water fed from the nozzle 3 is forced into the fine space 5 from the upstream end B and discharged from the opposite or downstream end C of the space 5 by virtue of rotation of the grinding wheel 1. At this time, the eliminating water pressure abruptly fluctuates between the upstream end B and the downstream end C, and by the abrupt fluctuation of the eliminating water pressure, cuttings deposited on the grinding surface is removed away therefrom, thereby preventing clogging of the grinding wheel 1. As described above, the eliminating water is forced into the fine space 5 by rotation of the grinding wheel 1 and is compressed, whereby the centripetal component of the water pressure with respect to the rotational axis O of the grinding wheel 1 is increased. The increased centripetal component of the eliminating water pressure abruptly changes at the exit or downstream end C of the space 5. The change of the centripetal component of the eliminating water at the exit end of the space virtually acts as a negative pressure and removes cuttings away from the grinding surface.

In this particular embodiment, the grinding wheel 1 and the opposed member 2 are electrically connected to a power source 4 so that an electrical voltage is applied therebetween. The cuttings deposited on the grinding surface are charged by the electrical voltage and are moved away from the grinding surface by the kinetic energy due to the attracting force or the repelling force given by the electric charge, whereby anti-clogging effect is enhanced. The power source 4 may be either a DC source or an AC source though the latter is preferred in view of larger energy fluctuation. When an electrical voltage is applied between the opposed member 2 and the grinding wheel 1, the opposed member 2 functions as an electrode and accordingly the opposed member 2 must be of a conductive material, e.g., carbon.

Though depending on the pressure of the eliminating water, the flow rate of the eliminating water and the like, the width t of the fine space 5 is generally not larger than 1 mm, and preferably from 0.05 mm to 0.5 mm. The length l is generally not smaller than 5 mm. The width of the opposed member 2 depends upon the width of the grinding surface. Further, though water is used as the eliminating liquid in this particular embodiment, the eliminating liquid need not be limited to water. Further, when an electrical voltage is applied between the opposed member 2 and the grinding wheel 1, the eliminating liquid is preferred to be conductive in order to enhance the electric field established between the opposed member 2 and the grinding wheel 1. For this purpose, an aqueous solution of an electrolyte may be used.

EXAMPLE 1

Using a pair of diamond grinding wheels, one provided with an anti-clogging device in accordance with the present invention and the other without any anti-clogging device, a plate material was ground and the times required for the diamond grinding wheels to be clogged to such an extent that requires dressing of the wheels (This time will be referred to as "clogging time", hereinbelow.) were measured. The opposed member employed in the anti-clogging device was substantially as shown in FIG. 1 in shape, and the width t of the fine space between the opposed member and the grinding wheel was 0.05 mm. The length l was 40 mm and the width of the grinding surface as measured in the direction parallel to the rotational axis of the grinding wheel 1 was 10 mm and equal to the width of the opposed member 2. The other conditions and the results are shown in Table 1.

TABLE 1

| | with anti-clogging device | without anti-clogging device |
|---|---|---|
| eliminating liquid | water | — |
| applied voltage | A.C. 24 V | — |
| cutting depth | 1.8 mm | 0.7 mm |
| wheel feed | 150 mm/min. | 50 mm/min. |
| clogging time | more than 24 h | 2 h |
| plate to be ground | silicon carbide 170 × 500 × 5 | |
| dimensions of wheel | 205 (diameter) × 10 (thickness) | |
| wheel rpm | 3000 | 75 |
| peripheral speed | 1900 | m/min. |
| cutting width | 10 | mm |
| driving motor power | 3.75 | kw |
| grinding fluid | water | |

As shown in Table 1, in the case of the grinding wheel without any anti-clogging device, grinding could not be continued any more after grinding for two hours due to clogging of the grinding wheel. On the other hand, in the case of the grinding wheel with the anti-clogging device of the present invention, grinding could be continued at least for twenty-four hours without dressing of the grinding wheel though the cutting depth is deeper and the wheel feed speed is higher than in the case of the grinding wheel without any anti-clogging device.

EXAMPLE 2

Using a pair of diamond grinding wheels, one provided with an anti-clogging device in accordance with the present invention and the other without any anti-clogging device, twenty-four square bars (60×60×8) arranged in three rows, eight in each row, were ground and the clogging times were measured. The opposed member employed in the anti-clogging device was substantially as shown in FIG. 1 in shape, and the width t of the fine space between the opposed member and the grinding wheel was 0.5 mm. The length 1 was 30 mm and the width of the grinding surface as measured in the direction parallel to the rotational axis of the grinding wheel 1 was 10 mm and equal to the width of the opposed member 2. The other conditions and the results are shown in Table 2.

TABLE 2

| | with anti-clogging device | without anti-clogging device |
|---|---|---|
| eliminating liquid | water | — |
| cutting depth | 1.0 mm | 0.7 mm |
| wheel feed | 90 mm/min. | 40 mm/min. |
| clogging time | more than 24 h | 2 h |
| material to be ground | HIP silicon nitride square bars | |
| dimensions of wheel | 205 (diameter) × 10 (thickness) | |
| wheel rpm | 3000 | rpm |
| peripheral speed | 1900 | m/min. |
| cutting width | 10 | mm |
| driving motor power | 3.75 | kw |
| grinding fluid | water | |

As shown in Table 2, in the case of the grinding wheel without any anti-clogging device, grinding could not be continued any more after grinding for two hours due to clogging of the grinding wheel. On the other hand, in the case of the grinding wheel with the anti-clogging device of the present invention, grinding could be continued at least for twenty-four hours without dressing of the grinding wheel though the cutting depth is deeper and the wheel feed speed is higher than in the case of the grinding wheel without any anti-clogging device.

Figure 2:
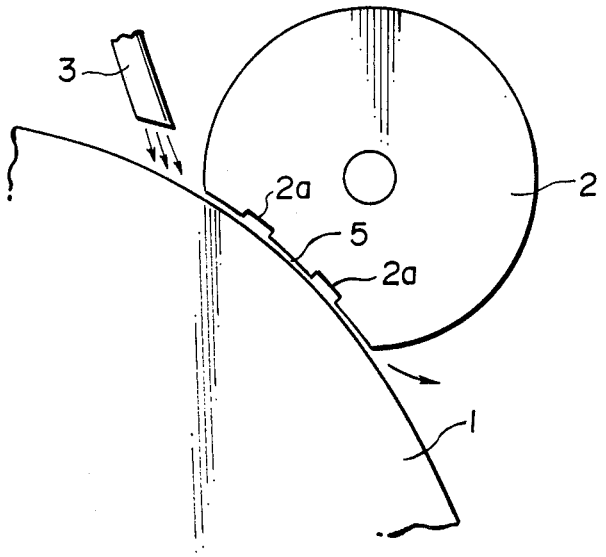
FIGS. 2 to 4 are schematic views respectively showing different embodiments of the present invention.

Though, in the embodiment shown in FIG. 1, the fine space 5 between the opposed member 2 and the grinding wheel 1 is substantially uniform in width t over the entire length, the fluctuation in the eliminating water pressure in the fine space 5 can be enhanced and the cuttings deposited on the grinding surface can be more effectively removed by forming one or more recesses 2*a* on the face of the opposed member 2 facing the grinding surface of the grinding wheel 1 as shown in FIG. 2.

Figure 3:
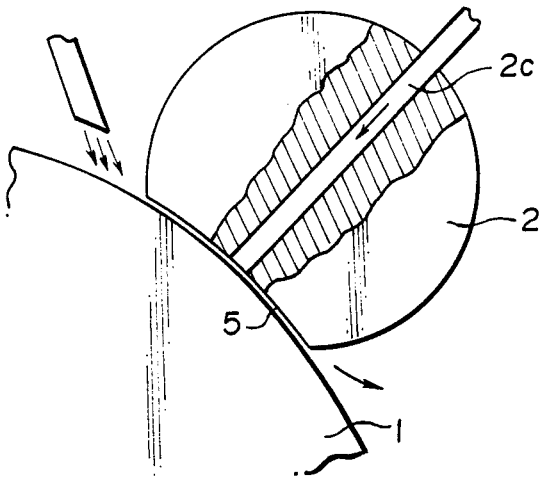

The fluctuation in the eliminating water pressure can be also enhanced by injecting additional eliminating water directly into an intermediate portion of the fine space 5 through a passage 2*c* formed through the opposed member 2 as shown in FIG. 3.

In the embodiments shown in FIGS. 1 to 3, the eliminating water feeding nozzle 3 is separate from the opposed member 2. However, the nozzle 3 may be formed integrally with the opposed member 2 so that the discharge end of the nozzle 3 is disposed in the vicinity of the grinding surface. This arrangement is advantageous in that the water pressure from the nozzle 3 can contribute to removing of the cuttings.

Figure 4:
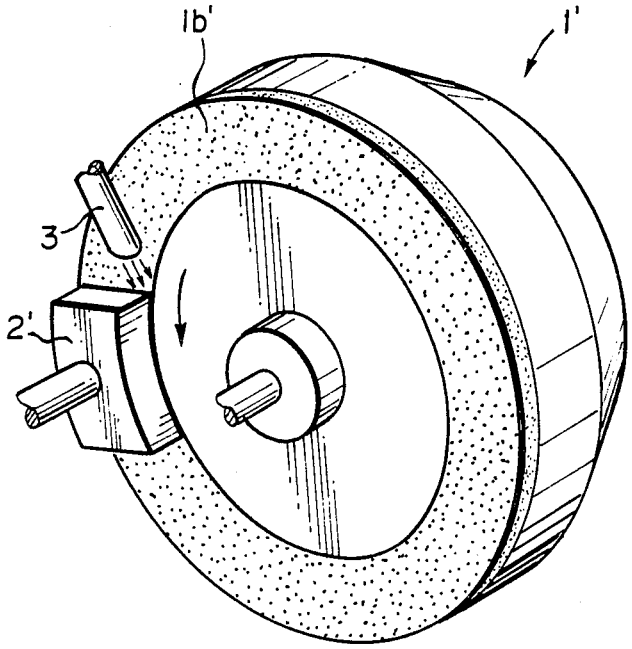

Though in the embodiments described above, the present invention is applied to the grinding wheel which is cylindrical or disk-like in shape and has the grinding surface on the outer peripheral surface thereof, the present invention may be applied to other various grinding wheels such as one shown in FIG. 4. The grinding wheel 1' is cup-like in the overall shape and has a grinding surface 1*b'* in the marginal area on an end face thereof. Of course, in this case, an opposed member 2' is provided to be opposed to the grinding surface 1*b'* in the marginal area on the end face of the grinding wheel 1'.

As can be understood from the description above, with the anti-clogging device of the present invention, the frequency at which dressing of the grinding wheel must be effected can be substantially lowered. However, it will be very convenient if the opposed member 2 is formed of a material suitable for dressing of the grinding wheel 1 so that by simply pressing the opposed member 2 against the rotating grinding wheel 1, dressing of the grinding wheel 1 can be effected.

Figure 5:
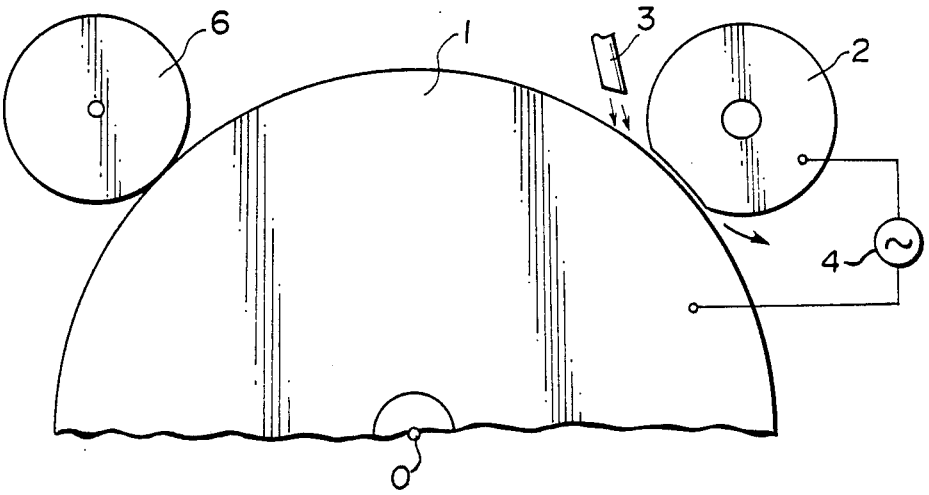
FIG. 5 is a schematic view showing a grinding wheel together with the anti-clogging device of FIG. 1 and a grinding wheel for dressing.

If desired, as illustrated in FIG. 5, a grinding wheel 6 for dressing may be disposed separately from the opposed member 2 to be opposed to the grinding surface of the grinding wheel 1 so that the dressing of the grinding wheel 1 and correction of partial abrasion of the grinding wheel or both 1 can be effected by pressing the grinding wheel 6 against the grinding wheel 1.

We claim:

1. An anti-clogging device for preventing a grinding surface of a grinding wheel from being clogged with cuttings, comprising: an opposed member which is opposed to the grinding surface of the grinding wheel over a predetermined length with a fine space therebetween, and an eliminating liquid feeding means which feeds cutting eliminating liquid into the fine space between the opposed member and the grinding surface from the outside of the opposed member at the end thereof facing in the direction opposite to the direction of rotation of the grinding wheel.

2. An anti-clogging device as defined in claim 1 in which said grinding wheel and the opposed member are connected to opposite poles of an electric power source so that an electric voltage is applied therebetween.

3. An anti-clogging device as defined in claim 1 or 2 in which the width of said fine space between the grinding surface and the opposed member is not larger than 1 mm.

4. An anti-clogging device as defined in claim 3 in which the width of said fine space is from 0.05 mm to 0.5 mm.

5. An anti-clogging device as defined in claim 1 or 2 in which said predetermined length is not shorter than 5 mm.

6. An anti-clogging device as defined in claim 1 or 2 in which said opposed member is provided with a passage therethrough for feeding additional cutting eliminating liquid to the fine space between the opposed member and the grinding surface.

7. An anti-clogging device as defined in claim 1 or 2 in which said cutting eliminating liquid is cooling water for cooling the grinding wheel during operation.

8. An anti-clogging device as defined in claim 1 or 2 in which said opposed member is formed of a material suitable for dressing of the grinding wheel and is adapted to be pressed against the grinding surface of the grinding wheel when dressing of the grinding wheel is desired.

9. An anti-clogging device as defined in claim 1 or claim 2, wherein the width of the fine space varies over the predetermined length.

10. An anti-clogging device as defined in claim 1 or claim 2, wherein the surface of the opposing member defining the fine space has at least one recess for enhancing fluctuation of the liquid pressure within the fine space.

* * * * *